US010663881B1

(12) United States Patent
Wakai et al.

(10) Patent No.: US 10,663,881 B1
(45) Date of Patent: May 26, 2020

(54) DEVELOPING DEVICE WITH AIRFLOW

(71) Applicant: FUJI XEROX CO., LTD., Tokyo (JP)

(72) Inventors: Takafumi Wakai, Kanagawa (JP); Takashi Akaike, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/382,215

(22) Filed: Apr. 12, 2019

(30) Foreign Application Priority Data

Dec. 19, 2018 (JP) ..... 2018-237575

(51) Int. Cl.
*G03G 15/08* (2006.01)
*G03G 21/20* (2006.01)

(52) U.S. Cl.
CPC ..... *G03G 15/0812* (2013.01); *G03G 15/081* (2013.01); *G03G 15/0898* (2013.01); *G03G 21/206* (2013.01); *G03G 2221/1645* (2013.01)

(58) Field of Classification Search
CPC ..... G03G 15/081; G03G 15/0812; G03G 15/0889; G03G 15/0891; G03G 15/0893; G03G 15/0898; G03G 21/206; G03G 2215/0838; G03G 2221/1645; G03G 2221/1648
USPC ..... 399/93, 274, 284
See application file for complete search history.

(56) References Cited

U.S. PATENT DOCUMENTS 4,583,112 A * 4/1986 Morano ..... G03G 15/0898 399/103
6,055,393 A * 4/2000 Anderson ..... G03G 15/0898 399/103
9,195,173 B2 * 11/2015 Ogawa ..... G03G 15/0898
2014/0270838 A1 * 9/2014 Yoshizawa ..... G03G 15/0893 399/99
2018/0081299 A1 * 3/2018 Okuno ..... G03G 15/0877
2018/0129150 A1 * 5/2018 Taniguchi ..... G03G 15/0891
2019/0025730 A1 * 1/2019 Akaike ..... G03G 15/0813
2019/0041769 A1 * 2/2019 Wakai ..... G03G 15/08

FOREIGN PATENT DOCUMENTS

JP 61140968 A * 6/1986 ..... G03G 15/0898
JP 61145570 A * 7/1986 ..... G03G 15/0898
JP 2005352076 12/2005
JP 2009115990 A * 5/2009
JP 2017026996 A * 2/2017
JP 2017111302 A * 6/2017

* cited by examiner

*Primary Examiner* — Robert B Beatty
(74) *Attorney, Agent, or Firm* — JCIPRNET

(57) ABSTRACT

A developing device includes a toner holding member that rotates while holding a toner on an outer peripheral surface of the toner holding member and develops an electrostatic latent image formed on an image carrier, a control member that controls a thickness of a layer of the toner formed on the outer peripheral surface of the toner holding member, a suppression member that has an end pressed against the image carrier and that suppresses leakage of the toner, a collecting member that is provided above the control member and that does not allow the toner flowing in a direction from the control member toward the collecting member to pass through the collecting member while allowing a gas to pass through the collecting member, and a containing chamber that contains the toner falling from the collecting member.

12 Claims, 8 Drawing Sheets

DEVELOPING DEVICE WITH AIRFLOW

CROSS-REFERENCE TO RELATED APPLICATIONS

This application is based on and claims priority under 35 USC 119 from Japanese Patent Application No. 2018-237575 filed Dec. 19, 2018.

BACKGROUND

(i) Technical Field

The present disclosure relates to a developing device.

(ii) Related Art

Japanese Unexamined Patent Application Publication No. 2005-352076 discloses an image forming apparatus that includes photoconductor units each of which includes a photoconductor drum and each of which is attachable and detachable to and from an image forming apparatus body and developing units each of which has a decompression hole for exhausting air inside the developing unit. Each of the photoconductor units includes a ventilation duct in which a dust collecting filter is disposed, and the air exhausted through the decompression holes of the developing units are discharged through the ventilation ducts.

There is known a configuration in which a developing device including a toner holding member that develops an electrostatic latent image is provided with a suppression member that suppresses leakage of a toner from the developing device to the outside. In such a configuration, the toner may sometimes accumulate in the suppression member as the developing device operates. In the case where the toner that has accumulated in the suppression member falls, in the form of, for example, a lump, onto the toner holding member, this causes an image quality defect such as a streak in an image that is formed.

SUMMARY

Aspects of non-limiting embodiments of the present disclosure relate to reducing the amount of a toner that accumulates in a suppression member to be smaller than that in the case where a flow path through which a gas in a developing device flows is not provided.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a developing device including a toner holding member that rotates while holding a toner on an outer peripheral surface of the toner holding member and develops an electrostatic latent image formed on an image carrier, a control member that controls a thickness of a layer of the toner formed on the outer peripheral surface of the toner holding member, a suppression member that has an end pressed against the image carrier and that suppresses leakage of the toner, a collecting member that is provided above the control member and that does not allow the toner flowing in a direction from the control member toward the collecting member to pass through the collecting member while allowing a gas to pass through the collecting member, and a containing chamber that contains the toner falling from the collecting member.

BRIEF DESCRIPTION OF THE DRAWINGS

Exemplary embodiments of the present disclosure will be described in detail based on the following figures, wherein.

DETAILED DESCRIPTION

An exemplary embodiment of the present disclosure will be described below with reference to the accompanying drawings.

<Image Forming Apparatus 1>

Figure 1:
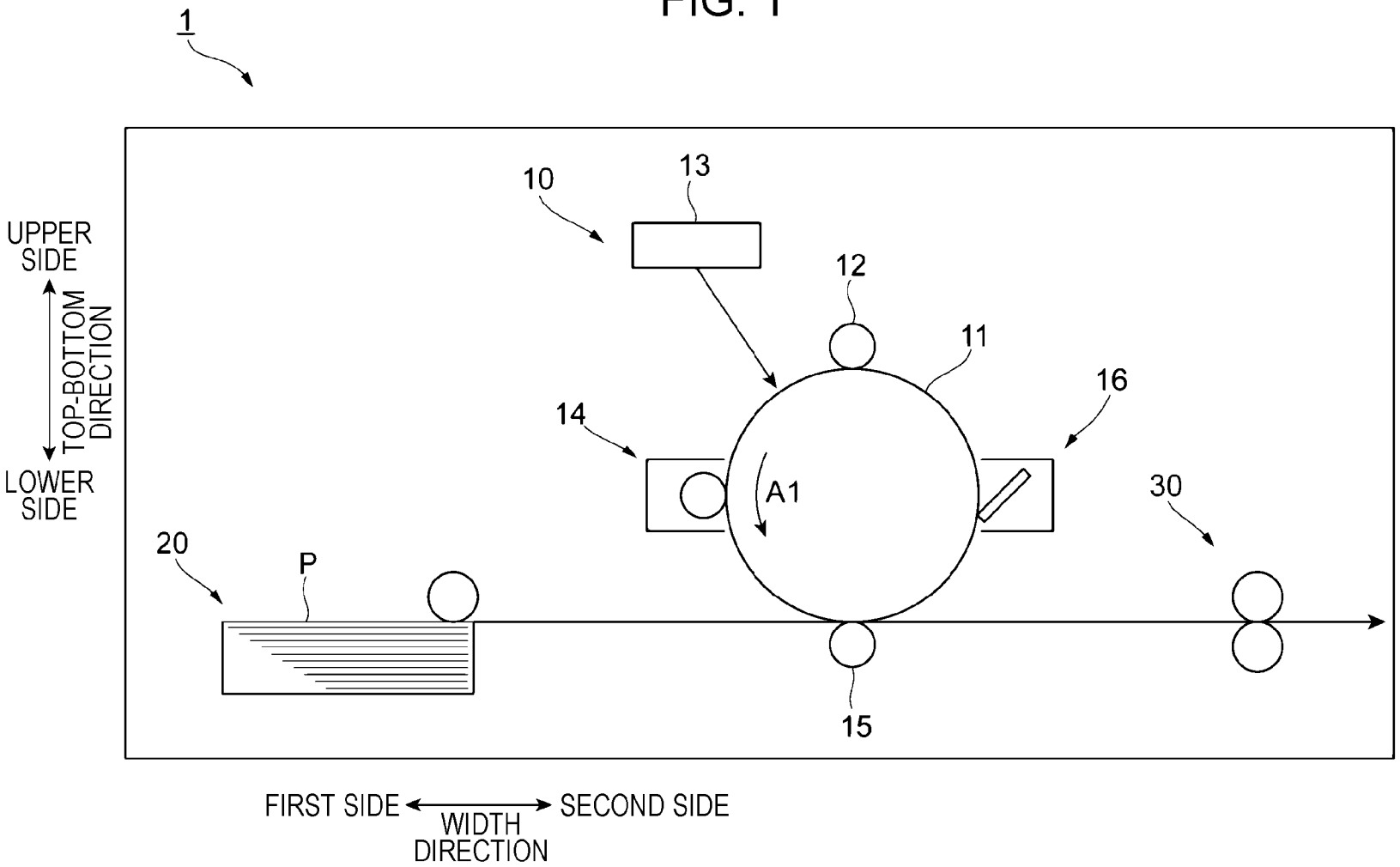
FIG. 1 is a diagram illustrating the overall configuration of an image forming apparatus according to an exemplary embodiment.

FIG. 1 is a diagram illustrating the overall configuration of an image forming apparatus 1 according to the present exemplary embodiment.

The image forming apparatus 1 includes an image forming unit 10, a sheet feeding unit 20, and a fixing unit 30. The image forming unit 10 employs an electrophotographic system and forms a monochromatic (e.g., black) toner image. The sheet feeding unit 20 feeds a sheet P to the image forming unit 10. The fixing unit 30 fixes an image (toner image) that has been formed on the sheet P by the image forming unit 10 onto the sheet P.

The image forming unit 10 includes a photoconductor drum 11 that rotates in the direction of arrow A1 in FIG. 1. The image forming unit 10 further includes a charging roller 12, an exposure device 13, a developing device 14, a transfer roller 15, and a cleaning device 16 that are arranged around the photoconductor drum 11 along the direction of arrow A1.

The photoconductor drum 11 includes a drum that is made of a metal and that has a thin-walled cylindrical shape and a photosensitive layer (not illustrated) that is formed on a surface of the drum. The photoconductor drum 11 is grounded.

The charging roller 12 includes a rubber roller that has electrical conductivity. The charging roller 12 is disposed in such a manner as to be in contact with the photoconductor drum 11. A charging bias for charging the photosensitive layer of the photoconductor drum 11 is applied to the charging roller 12.

The exposure device 13 selectively performs an optical writing operation on the photoconductor drum 11, which has been charged by the charging roller 12, by using a light source such as a light emitting diode (LED) or a laser beam so as to form an electrostatic latent image.

The developing device 14 develops an electrostatic latent image formed on the photoconductor drum 11 with a predetermined color toner (black toner in this case). A developer including the predetermined color toner is contained in the developing device 14. In the developing device 14, a so-called two-component developer including a magnetic carrier and a toner that is colored with a predetermined color is used as the developer. Note that details of the developing device 14 will be described later.

The transfer roller 15 includes a rubber roller that has electrical conductivity. The transfer roller 15 is disposed in such a manner as to be in contact with the photoconductor drum 11. The transfer roller 15 rotates and is driven by the photoconductor drum 11, which rotates. A transfer bias having a polarity opposite to the charge polarity of the toner is applied to the transfer roller 15.

The cleaning device 16 includes, for example, a blade member that is disposed in such a manner as to be in contact with the photoconductor drum 11 and removes substances (e.g., toner and the like) attached to the photoconductor drum 11 after a transfer operation has been performed and also before the photoconductor drum 11 is charged.

The sheet feeding unit 20 includes a container that contains the sheet P and a feeding mechanism that sends out the sheet P. The sheet feeding unit 20 further includes a transport mechanism (not illustrated) that transports the sheet P, which is sent out, to the outside via a transfer section at which the photoconductor drum 11 and the transfer roller 15 face each other and the fixing unit 30.

The fixing unit 30 includes a pair of rotating bodies that rotate in a state of being in contact with each other. The fixing unit 30 heats at least one of these two rotating bodies and causes the sheet P to pass through a fixing nip part that is formed between the two rotating bodies.

An image forming operation that is performed by the image forming apparatus 1 will now be described.

In the image forming unit 10, the photoconductor drum 11, which rotates in the direction of arrow A1, is charged by the charging bias, which is supplied to the charging roller 12. Next, the exposure device 13 starts performing a light exposure operation, and the photoconductor drum 11, which rotates in a state of being charged, is exposed to light by the exposure device 13. As a result, an electrostatic latent image is formed on the organic photosensitive layer, which has undergone the charging and light exposure operations.

Subsequently, along with rotation of the photoconductor drum 11, the electrostatic latent image formed on the photoconductor drum 11 reaches a development region that faces the developing device 14. The developing device 14 performs a developing operation on a portion of the photoconductor drum 11 that has passed through the development region, so that a toner image corresponding to the electrostatic latent image is formed.

The toner image that has been developed on the photoconductor drum 11 in the manner described above is moved along with rotation of the photoconductor drum 11 toward a transfer position that faces the transfer roller 15. In contrast, the sheet P, which is taken out from the sheet feeding unit 20, is transported to the transfer position by the transport mechanism (not illustrated) in accordance with the timing at which the toner image on the photoconductor drum 11 reaches the transfer position.

Then, the toner image developed on the photoconductor drum 11 reaches the transfer position, which faces the transfer roller 15, along with rotation of the photoconductor drum 11. In this case, the transfer bias is supplied to the transfer roller 15, so that the toner image formed on the photoconductor drum 11 is transferred onto the sheet P that passes through the transfer position. Note that substances including toner that remains on the photoconductor drum 11 after the transfer process has been performed are removed by the cleaning device 16.

After that, the sheet P to which the toner image has been transferred is heated and pressurized by passing through the fixing unit 30, so that the toner image is fixed onto the sheet P.

In the manner described above, the image forming operation for the single sheet P is completed.

Note that, in the following description, the top-bottom direction of the image forming apparatus 1 illustrated in FIG. 1 (the vertical direction) may sometimes be simply referred to as "top-bottom direction". In addition, the left-right direction of the image forming apparatus 1, which is illustrated in FIG. 1, as viewed in FIG. 1 may sometimes be simply referred to as "width direction". Furthermore, the depth direction of the image forming apparatus 1, which is illustrated in FIG. 1, as viewed in FIG. 1 may sometimes be simply referred to as "depth direction".

<Developing Device 14>

Figure 2:
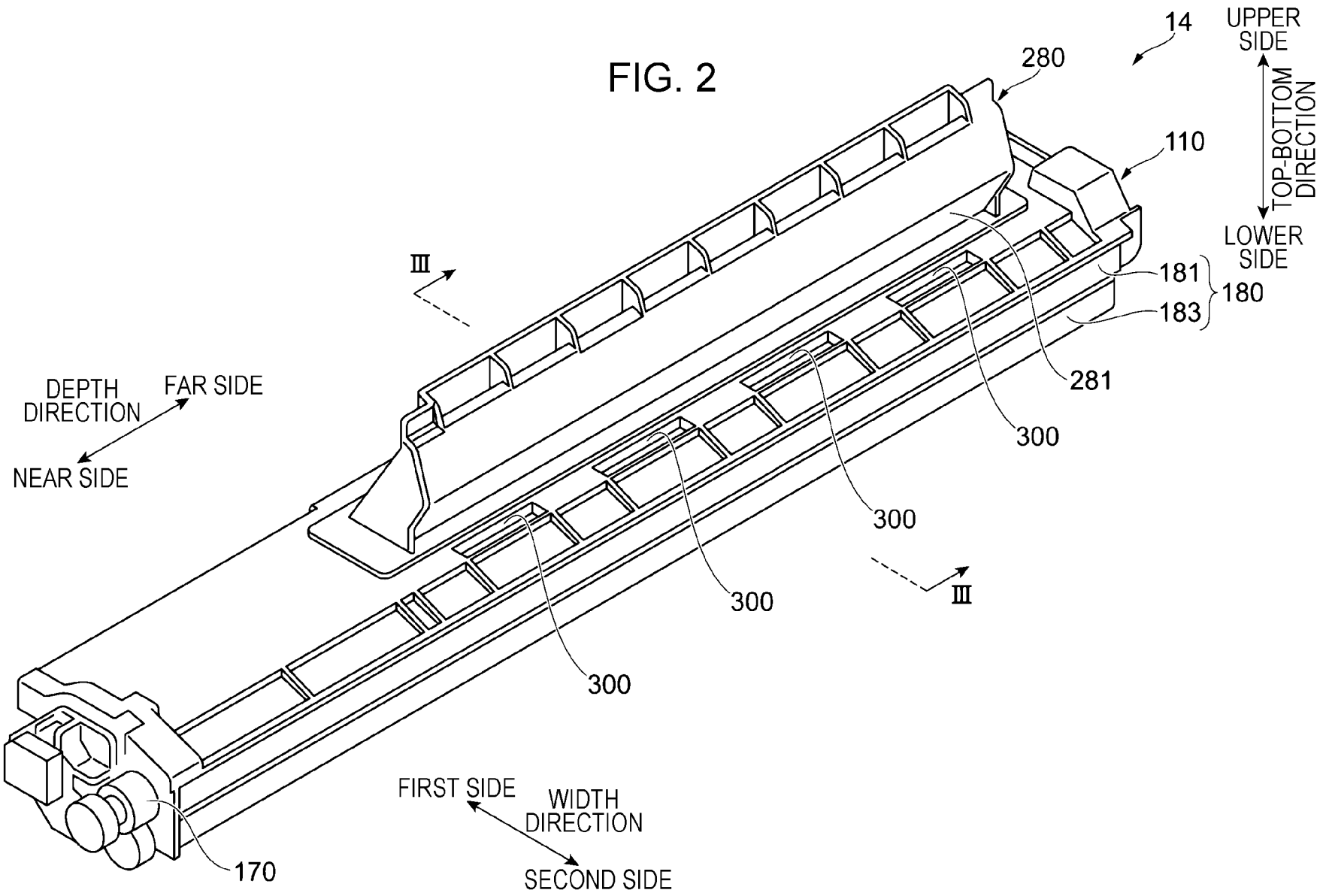
FIG. 2 is a perspective view of a developing device according to the exemplary embodiment.

FIG. 2 is a perspective view of the developing device 14 according to the present exemplary embodiment.

Figure 3:
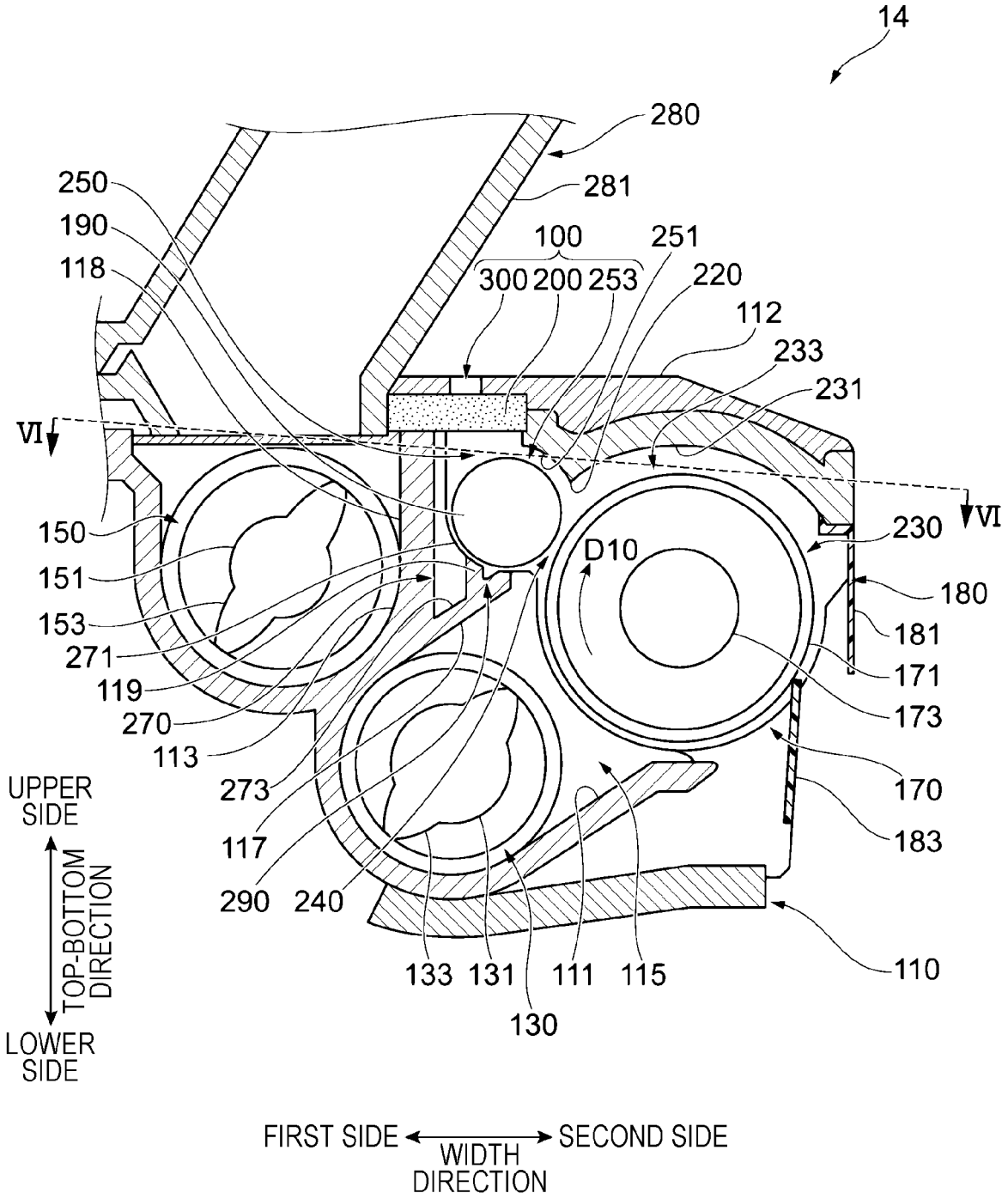
FIG. 3 is a cross-sectional view of the developing device taken along line III-III of FIG. 2.

FIG. 3 is a cross-sectional view of the developing device 14 taken along line III-III of FIG. 2.

A schematic configuration of the developing device 14 will now be described with reference to FIG. 1 to FIG. 3.

As illustrated in FIG. 2, the developing device 14 includes a housing 110 that accommodates functional component members that are used for developing an electrostatic latent image formed on the photoconductor drum 11 (see FIG. 1) and a developer supplying unit 280 that contains the developer to be supplied to the housing 110.

Here, the developer supplying unit 280 illustrated in FIG. 2 is disposed on the upper side of the housing 110. Although not illustrated, through holes are formed in a portion of the developer supplying unit 280 and in a portion of the housing 110, these portions facing each other. A film member is disposed in such a manner as to cover the through holes of the developer supplying unit 280. After the developing device 14 has been installed in the image forming apparatus 1, and the film member has been removed, the developer contained in the developer supplying unit 280 passes through the through holes and falls in such a manner as to be supplied to the housing 110.

Note that the developer supplying unit 280 has an inclined surface 281 that is located above a filter 200 and through holes 300, which will be described later, in the top-bottom direction and that is inclined with respect to the top-bottom direction. More specifically, the inclined surface 281 is inclined in such a manner as to extend upward in the top-bottom direction toward a second side in the width direction.

As illustrated in FIG. 3, the developing device 14 includes a first auger 130 and a second auger 150 that are disposed in the housing 110 and that transport the developer while stirring the developer, a developing roller 170 that holds the developer on the outer peripheral surface thereof, a seal 180 that suppresses leakage of the toner from the developing device 14, and a trimmer 190 that controls the layer thickness of the developer held by the developing roller 170. Note that the first auger 130, the second auger 150, the developing roller 170, the seal 180, and the trimmer 190 are arranged approximately parallel to the photoconductor drum 11 (see FIG. 1).

The interior of the housing 110 is divided into a plurality of spaces by, for example, a first partition plate 117 and a second partition plate 118 that are disposed in such a manner as to extend in the depth direction. The housing 110 illustrated in FIG. 3 includes an auger accommodating chamber 115 in which the first auger 130 and the second auger 150 are accommodated, a developing-roller accommodating chamber 230 in which the developing roller 170 is accommodated, and a trimmer accommodating chamber 250 in which the trimmer 190 is accommodated. The configuration of each of these accommodating chambers and the functional component members that are accommodated in the accommodating chambers will be described below.

The auger accommodating chamber 115 is a space that is continuous with the developing-roller accommodating chamber 230. The auger accommodating chamber 115 contains the developer. In addition, the auger accommodating chamber 115 includes a first chamber 111 and a second chamber 113 that are isolated from each other by the partition plate 117 excluding the end portions of thereof in the depth direction. The first auger 130 and the second auger 150 are respectively disposed in the first chamber 111 and the second chamber 113.

Here, the first auger 130 includes a rotary shaft 131 and a blade portion 133 that is provided on the outer periphery of the rotary shaft 131 in a helical manner. The second auger 150 includes a rotary shaft 151 and a blade portion 153 that is provided on the outer periphery of the rotary shaft 151 in a helical manner. The first auger 130 and the second auger 150 receive a driving force that is transmitted from a driving source (not illustrated) and rotate in, for example, opposite directions. The first auger 130 and the second auger 150 transport the toner toward opposite sides in the depth direction (see arrow D11 and arrow D12 in FIG. 4, which will be described later) while stirring the toner and the carrier. As a result, the developer circulates in the auger accommodating chamber 115. In addition, an electric charge is generated in the toner as a result of the toner and the carrier rubbing against each other.

The developing-roller accommodating chamber 230 is a space that is continuous with the auger accommodating chamber 115 and the trimmer accommodating chamber 250. The developing-roller accommodating chamber 230 is open toward the photoconductor drum 11. The developing roller 170 is disposed in the developing-roller accommodating chamber 230. Note that a detailed configuration of the developing-roller accommodating chamber 230 will be described later.

Here, the developing roller 170 includes a developing sleeve 171 that is rotatably disposed and a magnet roller 173 that is disposed in a space enclosed by the developing sleeve 171 and fixed in place. A plurality of magnetic poles are arranged in or on the magnet roller 173. The developing sleeve 171 receives a driving force that is transmitted from a driving source (not illustrated) and is driven so as to rotate in the direction of arrow D10. Then, the developer that is held on the outer periphery of the developing sleeve 171 by the magnetic force of the magnet roller 173 is transported toward a region that faces the photoconductor drum 11 (see FIG. 1) along with rotation of the developing sleeve 171.

The trimmer accommodating chamber 250 is continuous with the developing-roller accommodating chamber 230. The trimmer 190 is disposed in the trimmer accommodating chamber 250. Note that a detailed configuration of the trimmer accommodating chamber 250 will be described later.

Here, the trimmer 190 is a so-called round rod trimmer that is a member having a columnar shape. The ends of the trimmer 190 are held by the housing 110. The trimmer 190 controls the layer thickness of the developer, which is held by the developing roller 170, so as to be a predetermined thickness in an opposing region 240 that faces the developing roller 170.

In the housing 110 illustrated in FIG. 3, the seal 180 is disposed at the opening of the developing-roller accommodating chamber 230 that is opened toward the photoconductor drum 11. The seal 180 illustrated in FIG. 3 includes a first seal 181 and a second seal 183 that are disposed at positions along the direction of arrow D10, which is the direction of rotation of the developing sleeve 171. The first seal 181 and the second seal 183 are plate-shaped member each of which is made of, for example, a resin. In other words, the first seal 181 and the second seal 183 are film members. The first seal 181 is disposed in such a manner that an end thereof is pressed against the photoconductor drum 11. The second seal 183 is disposed in such a manner that an end thereof is pressed against the developing sleeve 171.

The first seal 181 and the second seal 183 each have a function of serving as a shielding member (a sealing member) that suppresses leakage of floating toner (so-called cloud), which is the toner floating in the housing 110, to the outside. More specifically, the first seal 181 and the second seal 183 prevent the toner from depositing onto the exposure device 13 and so forth that are arranged around the developing device 14.

<Gas Exhaust Path 100>

Figure 4:
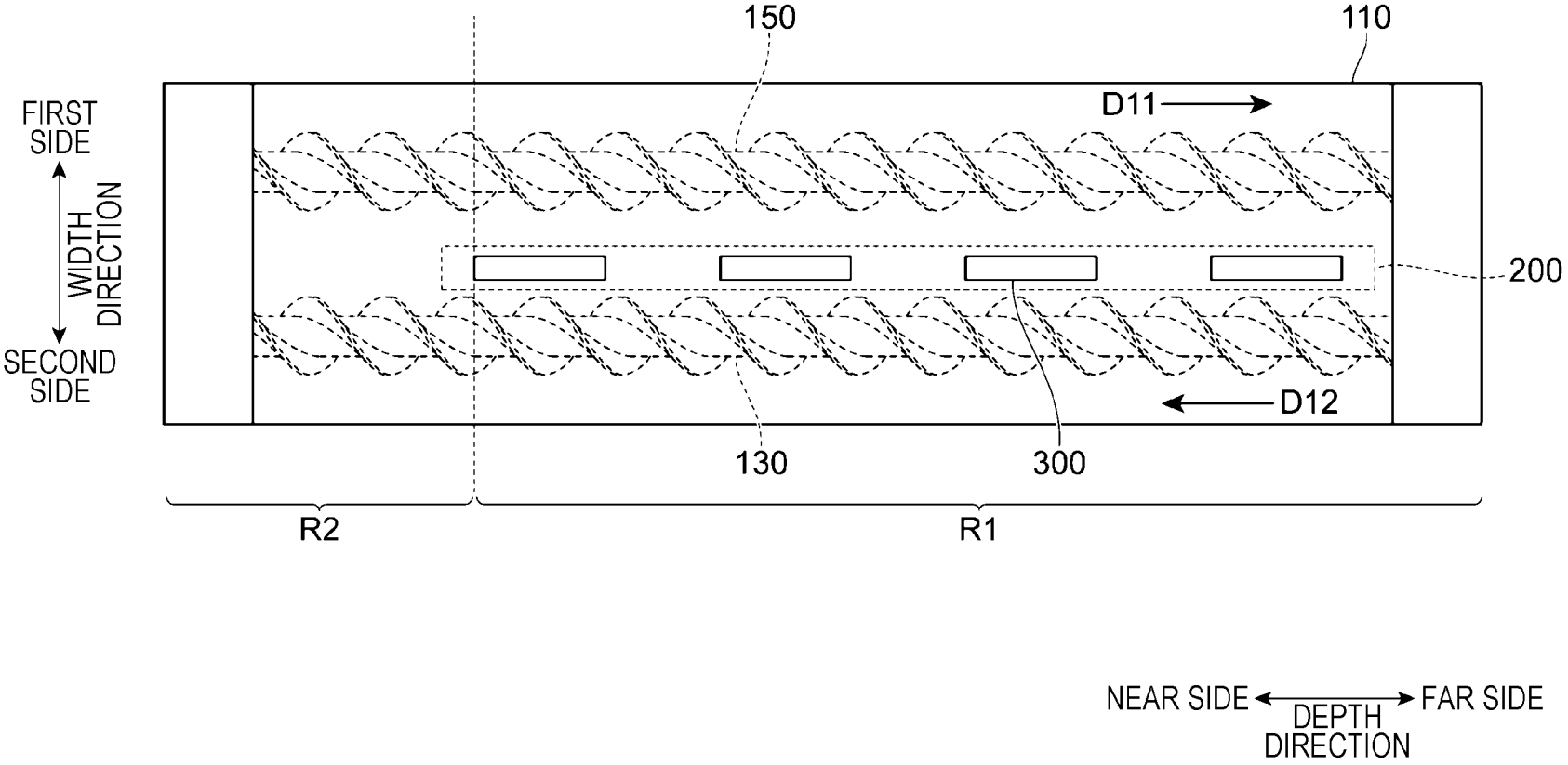
FIG. 4 is a diagram illustrating an arrangement of a filter and through holes in a housing.

FIG. 4 is a diagram illustrating the arrangement of the filter 200 and the through holes 300 in the housing 110.

Figure 5:
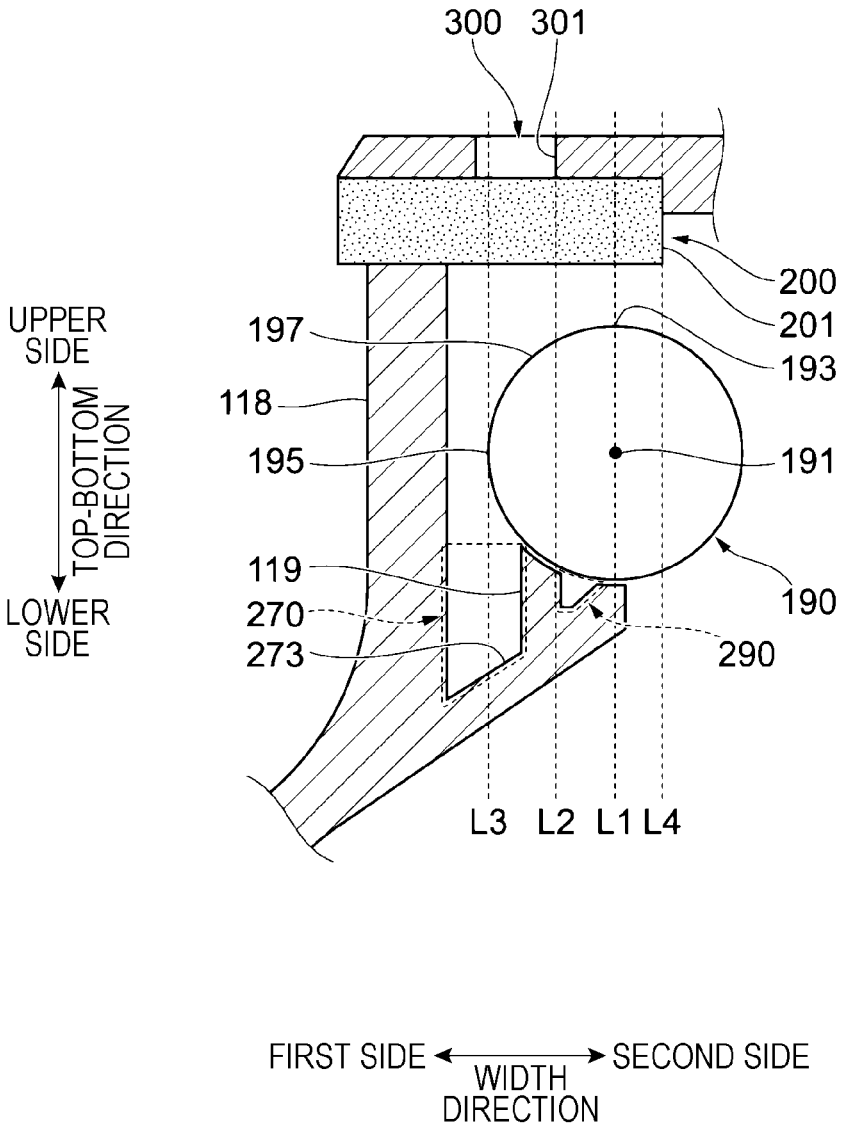
FIG. 5 is a diagram illustrating an arrangement of a trimmer, the filter, and the through holes.

FIG. 5 is a diagram illustrating the arrangement of the trimmer 190, the filter 200, and the through holes 300.

A gas exhaust path 100 that is formed in the developing device 14 will now be described with reference to FIG. 3 to FIG. 5.

First, as illustrated in FIG. 3, when the developing roller 170 rotates while the developing device 14 is operating, a gas in the vicinity of the developing roller 170 moves along with the developing roller 170. In other words, a flow of the gas in the direction of rotation of the developing roller 170 (see arrow D10) is generated. When the floating toner in the housing 110 is transported by this flow of the gas, the toner is deposited or accumulates onto the inner side of the first seal 181 that is disposed on a downstream side in the direction of rotation of the developing roller 170.

Here, the toner accumulated on the first seal 181 may sometimes cause degradation of the quality of an image that is formed on the sheet P. For example, when the toner deposited on the first seal 181 is influenced by, for example, vibration and falls in the form of a lump onto the developing sleeve 171, a thick streak or the like is generated in the image that is formed on the sheet P.

In the present exemplary embodiment, the gas exhaust path 100 that is a flow path that allows the gas (air) to flow along the trimmer 190 is provided. The gas exhaust path 100 is separated into paths, while being curved, from a position that is further downstream than the trimmer 190 and further upstream than the first seal 181 in the direction of rotation of the developing sleeve 171 (see arrow D10). More specifically, a route for exhausting the air, that is, the gas exhaust path 100 through which the gas in the housing 110 is exhausted to the outside of the housing 110, is provided at a position that is further upstream than the first seal 181 in the direction of rotation of the developing sleeve 171 in such a manner as to reduce the amount of the toner that accumulates onto the first seal 181.

To describe it specifically, the gas exhaust path 100 illustrated in FIG. 3 includes a first curved path 233, a second curved path 253 that branches off from the first curved path 233, the filter 200 that collects the toner that flows through the second curved path 253, and the through holes 300 that allow the gas flowing from the filter 200 to pass therethrough to the outside of the housing 110.

The first curved path 233, the second curved path 253, the filter 200, and the through holes 300 will be described below.

The first curved path 233 is a space that is located between a first curved surface 231 of the developing-roller accommodating chamber 230 and the outer peripheral surface of the developing sleeve 171. Here, the first curved surface 231 is an upper inner wall of the housing 110 that forms a portion of the developing-roller accommodating chamber 230 and has a shape that is curved along the developing sleeve 171 of the developing roller 170. The first curved path 233 is formed as an arc-shaped flow path that has a predetermined width (e.g., 2 mm). In addition, the first curved path 233 is formed in such a manner as to extend from the opposing region 240, which extends in the direction of rotation of the developing sleeve 171 (see arrow D10), to the first seal 181.

The second curved path 253 is a space that is located between a second curved surface 251 of the developing-roller accommodating chamber 230 and the outer peripheral surface of the trimmer 190. Here, the second curved surface 251 is the upper inner wall of the housing 110 that forms a portion of the developing-roller accommodating chamber 230 and has a shape that is curved along the trimmer 190. The second curved path 253 is formed as an arc-shaped flow path that has a predetermined width (e.g., 1.5 mm). In addition, the second curved path 253 is formed in such a manner as to extend from a branch point 220 where the second curved path 253 branches off from the first curved path 233 to the filter 200.

The filter 200 is a member that does not allow the toner to pass therethrough while allowing the gas to pass therethrough. More specifically, the filter 200 is a member that has breathability and has a large number of openings each of which is smaller than the particle dimension of the toner. The filter 200 may also be considered as a mesh body that is a member in the form of a mesh. In addition, the filter 200 is formed of, for example, a member such as a piece of nonwoven fabric or a resin member that has permeability higher than that of the housing 110. The filter 200 illustrated in FIG. 3 is a plate-shaped member made of urethane and is positioned so as to cover the through holes 300. More specifically, as illustrated in FIG. 4, the filter 200 is a plate-shaped member that is elongated and is positioned so as to cover the plurality of through holes 300 that are arranged in the depth direction.

The through holes 300 are openings that are formed in an upper surface 112 of the housing 110 and allows communication between the internal space of the housing 110 and the outside. More specifically, the through holes 300 are openings that allows the gas in the trimmer accommodating chamber 250 to flow out of the housing 110. In other words, the through holes 300 allows the gas flowing from the first curved path 233 to flow out of the housing 110. As illustrated in FIG. 4, the through holes 300 are openings each of which has a substantially rectangular shape when viewed in plan view and are arranged in the depth direction. In the case illustrated in FIG. 4, the plurality of through holes 300 (four through holes 300) are arranged in the depth direction.

The arrangement of the filter 200 and the through holes 300 will now be described in detail with reference to FIG. 3 to FIG. 5.

As illustrated in FIG. 4, the filter 200 and the through holes 300 are provided on a far side of the housing 110 in the depth direction (see a region R1 in FIG. 4) and are not provided on a near side of the housing 110 in the depth direction (see a region R2 in FIG. 4). More specifically, the filter 200 and the through holes 300 are provided on an upstream side in a direction in which the developer is transported by the first auger 130 (see arrow D12) and are not provided on a downstream side in this direction.

The developer that is transported by the second auger 150 toward the far side in the depth direction (see arrow D11) changes its transport direction and starts moving toward the near side in the depth direction (see arrow D12) in a region of the first auger 130 that is located on the far side in the depth direction. As the direction of movement of the developer is changed in this manner, the developer is more likely to stay in the region of the first auger 130 on the far side in the depth direction than in a region of the first auger 130 that is located on the near side in the depth direction. As a result, when the developer is supplied from the first auger 130 to the developing roller 170, the toner is more likely to float on the far side in the depth direction than on the near side in the depth direction. Accordingly, in the case illustrated in FIG. 4, the filter 200 and the through holes 300 are arranged on the upstream side in the transport direction of the developer (see arrow D12) in such a manner as to more reliably reduce the amount of the toner that flows toward the first seal 181.

As illustrated in FIG. 5, the filter 200 is disposed at a position further toward a first side in the width direction (the left-hand side in FIG. 5) than the trimmer 190 is. More specifically, the filter 200 is disposed in such a manner that a portion of the filter 200 that is located on the first side in the width direction is larger than a portion of the filter 200 that is located further toward a second side in the width direction than an imaginary line L1 passing through the center 191 of the trimmer 190 or through a top 193 of the trimmer 190 is.

As illustrated in FIG. 5, the through holes 300 are formed at positions further toward the first side in the width direction than the trimmer 190 is. More specifically, the through holes 300 are located further toward the first side in the width direction than the imaginary line L1 is. An end 301 of each of the through holes 300 on the second side in the width direction is located further toward the first side in the width direction than the imaginary line L1 is (see an imaginary line L2). In addition, the end 301 of each of the through holes 300 is located further toward the second side in the width direction than an imaginary line L3 passing through a top 195 of the trimmer 190 that is located on the first side in the width direction is. Consequently, the through holes 300 are open at positions where the through holes 300 overlap a top surface 197 of the trimmer 190 in the top-bottom direction. With this positional relationship, the floating toner that flows toward the through holes 300 along with the flow of the gas is collected by the filter 200 and then falls onto the trimmer 190.

<Toner Containing Chamber>

Figure 6:
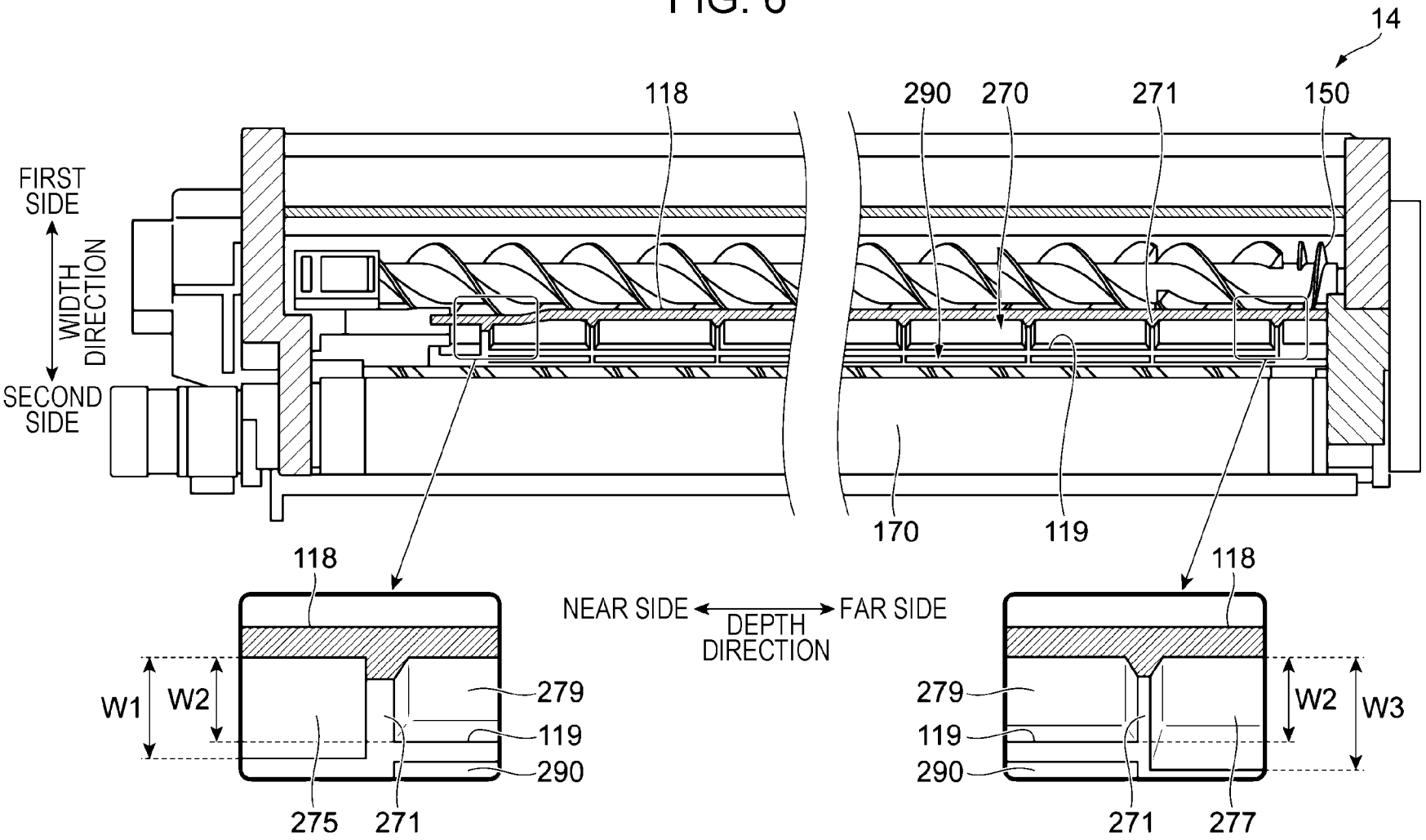
FIG. 6 is a cross-sectional view of the developing device taken along line VI-VI of FIG. 3.

FIG. 6 is a cross-sectional view of the developing device 14 taken along line VI-VI of FIG. 3. Note that the trimmer 190 is not illustrated in FIG. 6.

Although not described above, the housing 110 includes a first toner containing chamber 270 and a second toner containing chamber 290 in which the toner that falls from the filter 200 is to be contained. The first toner containing chamber 270 and the second toner containing chamber 290 will be described below with reference to FIG. 3 to FIG. 6.

As illustrated in FIG. 3, the first toner containing chamber 270 and the second toner containing chamber 290 are formed as portions of the trimmer accommodating chamber 250. The first toner containing chamber 270 and the second toner containing chamber 290, which are illustrated in FIG. 3, are formed to be open toward the trimmer 190 disposed in the trimmer accommodating chamber 250. In the configuration illustrated in FIG. 3, the developer is not allowed to flow from the first chamber 111 of the auger accommodating chamber 115 into the first toner containing chamber 270 and the second toner containing chamber 290 without passing through the second curved path 253. In other words, the toner that has passed through the second curved path 253 flows into the first toner containing chamber 270 and the second toner containing chamber 290.

Here, as illustrated in FIG. 5, the first toner containing chamber 270 is a space that is located below the upper end of a third partition plate 119 partitioning the first toner containing chamber 270 and the second toner containing chamber 290 from each other and that is located between the third partition plate 119 and the second partition plate 118. The first toner containing chamber 270 is formed under the filter 200 in the top-bottom direction. In addition, the first toner containing chamber 270 is formed to be located below the center 191 of the trimmer 190 in the top-bottom direction and to be located further toward the first side in the width direction than the center 191 of the trimmer 190 is. Furthermore, in the top-bottom direction, the first toner containing chamber 270 is formed to be located under the top 195 of the trimmer 190, which is located on the first side in the width direction. A bottom surface 273 of the first toner containing chamber 270 is inclined in such a manner as to extend downward in the top-bottom direction toward the first side in the width direction. This increases the containing space in the first toner containing chamber 270.

The second toner containing chamber 290 is formed under the trimmer 190 in the top-bottom direction and is located further toward the second side in the width direction than the first toner containing chamber 270 is. Note that the second toner containing chamber 290 illustrated in FIG. 5 is formed in a region in the housing 110 that faces a lower surface of the trimmer 190 and is a portion that is recessed in a direction away from the outer peripheral surface of the trimmer 190.

As illustrated in FIG. 6, in the housing 110, the first toner containing chamber 270 and the second toner containing chamber 290 are provided on the far side in the depth direction and are not provided on the near side in the depth direction. More specifically, in the depth direction, the first toner containing chamber 270 and the second toner containing chamber 290 are provided only at positions where the filter 200 and the through holes 300 are arranged. This reduces the dimensions of the first toner containing chamber 270 and the second toner containing chamber 290 in the housing 110, so that the degree of freedom when designing the housing 110 increases.

In addition, as illustrated in FIG. 6, the first toner containing chamber 270 and the second toner containing chamber 290 are divided into a plurality of spaces by a plurality of walls, specifically, a plurality of ribs 271 that are formed with predetermined intervals therebetween in the depth direction. As a result of the first toner containing chamber 270 and the second toner containing chamber 290 being divided by the ribs 271 in this manner, movement of the toner contained in these containing chambers in the depth direction is suppressed. In other words, the probability that the toner contained in the first toner containing chamber 270 and the second toner containing chamber 290 will be unevenly distributed to one side in the depth direction and will overflow from the first toner containing chamber 270 or the second toner containing chamber 290 is reduced.

Among the plurality of spaces that are formed by dividing the first toner containing chamber 270 by the ribs 271, the nearest space in the depth direction (the leftmost space in FIG. 6) will be referred to as a first end chamber 275, and the farthest space in the depth direction (the rightmost space in FIG. 6) will be referred to as a second end chamber 277. The rest of the plurality of spaces that are located between the first end chamber 275 and the second end chamber 277 will be referred to as intermediate chambers 279.

Here, in the width direction, a width W1 of the first end chamber 275 is larger than a width W2 of each of the intermediate chambers 279. In addition, a width W3 of the second end chamber 277 is larger than the width W2 of each of the intermediate chambers 279. This increases the containing spaces of the first end chamber 275 and the second end chamber 277. Thus, if the toner moves in the depth direction beyond the ribs 271, the probability that the toner will overflow from the first end chamber 275 or the second end chamber 277 is reduced. Note that, in the case illustrated in FIG. 6, the width W3 of the second end chamber 277 is larger than the width W1 of the first end chamber 275. This increases the containing space of the second end chamber 277 located on the far side in the depth direction in which the toner is more likely to float than in the first end chamber 275 located on the near side in the depth direction and that may contain a larger amount of the toner than the first end chamber 275.

<Flow of Toner>

Figure 7:
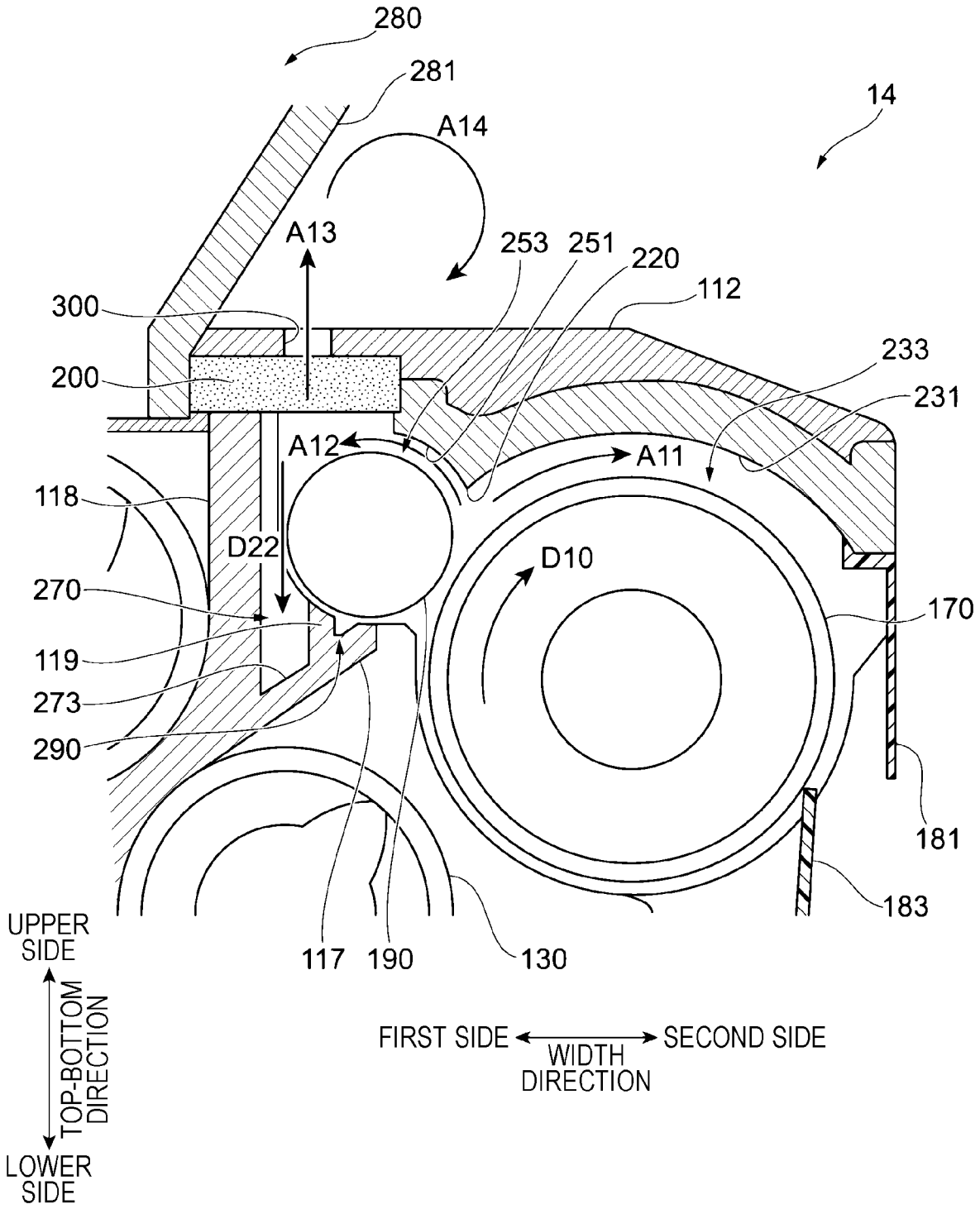
FIG. 7 is a diagram illustrating a flow of a toner in the developing device.

FIG. 7 is a diagram illustrating a flow of the toner in the developing device 14.

The flow of the toner associated with the flow of the gas in the vicinity of the developing roller 170 will now be described with reference to FIG. 7.

First, as illustrated in FIG. 7, as the developing sleeve 171 of the developing roller 170 rotates (see arrow D10), the gas flows along the first curved path 233 in a direction toward the first seal 181 (see arrow A11). In this case, the gas flows into the second curved path 253 that branches off from the first curved path 233 (see arrow A12), so that the amount of the gas moving toward the first seal 181 is reduced. This reduces the amount of the floating toner that is deposited onto the first seal 181.

Then, the gas flowing through the second curved path 253 passes through the filter 200 and the through holes 300 and is discharged to the outside of the housing 110 (see arrow A13). In this case, the floating toner is collected by the filter 200, so that the probability of the floating toner being discharged to the outside of the housing 110 is reduced. In addition, the second curved path 253 is formed of the second curved surface 251 and the outer peripheral surface of the trimmer 190 that are smooth surfaces, so that the probability that the flow of the gas will stagnate in the second curved path 253, and the toner will be deposited onto the second curved surface 251 and so forth is reduced. In other words, as a result of the second curved path 253 being formed of the smooth surfaces, which are the second curved surface 251 and the outer peripheral surface of the trimmer 190, the amount of the toner that is collected by the filter 200 increases.

The toner collected by the filter 200 is contained in the first toner containing chamber 270 located under the filter 200 in the top-bottom direction. In other words, the toner collected by the filter 200 falls on the rear surface side of the trimmer 190 when viewed from the second curved path 253. As a result, the probability that the toner collected by the filter 200 will flow (flow backward) to the side on which the first curved path 233 is formed via the second curved path 253 is reduced.

In the case illustrated in FIG. 7, the trimmer 190 is disposed below the filter 200 in the top-bottom direction. Consequently, the outer peripheral surface of the trimmer 190 receives the toner falling from the filter 200 and then guides the toner toward the first toner containing chamber 270. As a result, the toner is contained into the first toner containing chamber 270 with higher certainty.

Here, although the trimmer 190 illustrated in FIG. 7 is not configured to rotate by being driven, the ends of the trimmer 190, which are held by the housing 110, are allowed to rotate. If the toner contained in the first toner containing chamber 270 is deposited onto the trimmer 190, and the trimmer 190 rotates (rotates on its axis) in the counterclockwise direction in FIG. 7 by receiving an external force, the toner may move along the trimmer 190 toward the developing roller 170. Accordingly, in the case illustrated in FIG. 7, the second toner containing chamber 290 is provided, and the toner deposited on the trimmer 190 falls and is contained in the second toner containing chamber 290. As a result, the amount of the toner that is moved toward the developing roller 170 by the trimmer 190 is reduced.

In the case illustrated in FIG. 7, the inclined surface 281 of the developer supplying unit 280 is positioned as a surface that is inclined with respect to the flow of the gas that passes through the filter 200 and the through holes 300 and that is discharged to the outside of the housing 110 (see arrow A13). The gas discharged from the through holes 300 hits the inclined surface 281, so that the direction of its flow is changed, and the gas flows in a direction toward the developing roller 170. More specifically, in the case illustrated in FIG. 7, the gas that flows so as to hit the inclined surface 281 flows in a direction in which a vortex flow of the gas is generated (see arrow A14). Thus, the path through which the gas flows to reach the outside of the developing device 14 is longer than that in the case where the gas that is discharged from the through holes 300 linearly flows. As a result, even if the floating toner passes through the filter 200, the probability of the floating toner reaching the outside of the developing device 14 is reduced. More specifically, by reducing the probability of the floating toner reaching the outside of the developing device 14, a member having higher permeability may be used as the filter 200.

In addition, as a result of the flow of the gas from the through holes 300 becoming a vortex flow (see arrow A14), the pressure on the upper side of the through holes 300 becomes a negative pressure with respect to the pressure on the lower side of the through holes 300. This pressure difference facilitates exhausting of the gas through the through holes 300. As an additional point, the inclined surface 281 of the developer supplying unit 280 illustrated in FIG. 7 exerts a rectification effect.

<Modification 1>

Figure 8:
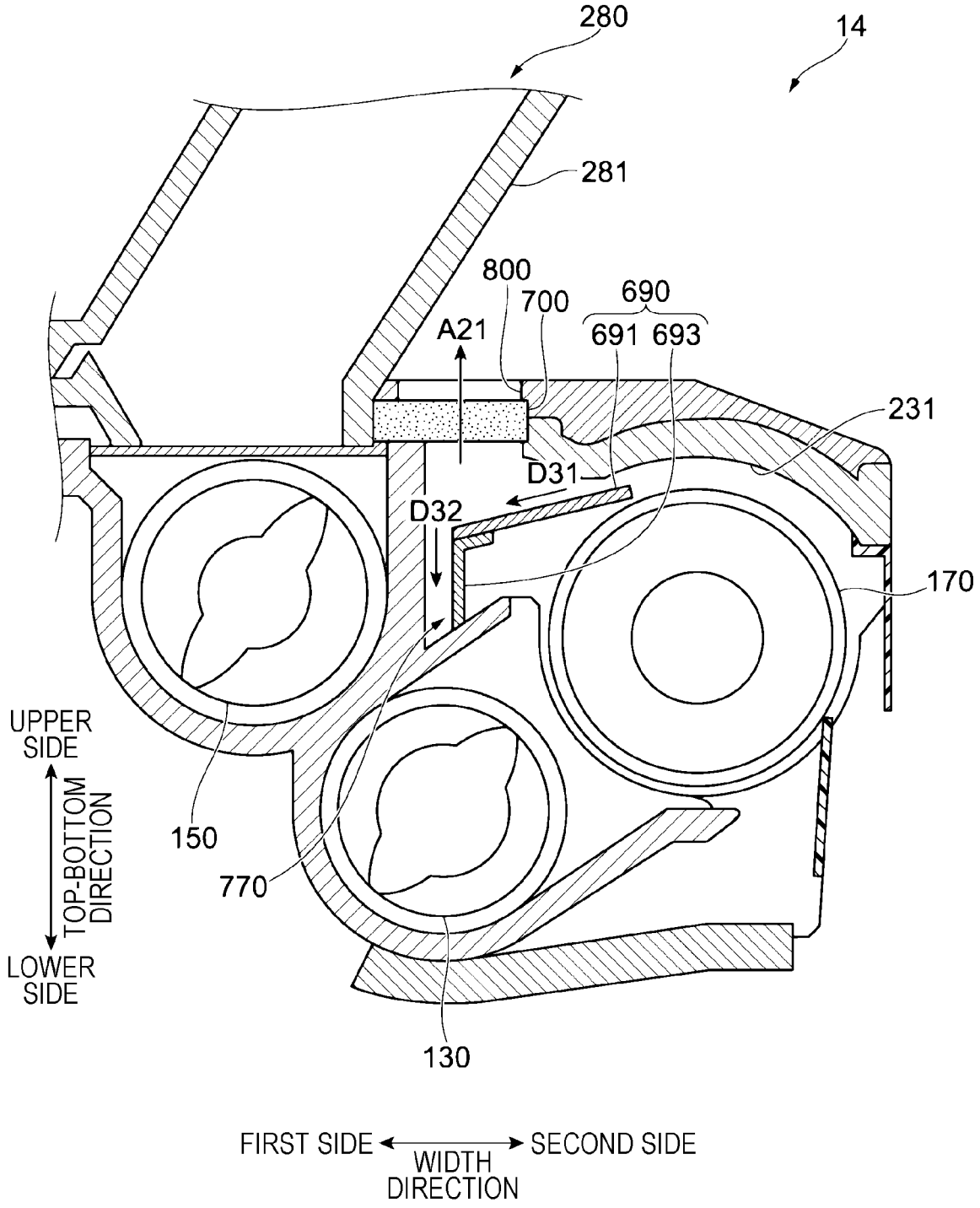
FIG. 8 is a diagram illustrating a modification.

FIG. 8 is a diagram illustrating a modification.

A modification of the above-described exemplary embodiment will now be described with reference to FIG. 8. In the following description, components that are the same as the components according to the above-described exemplary embodiment are denoted by the same reference signs, and descriptions thereof may sometimes be omitted.

In the above-described exemplary embodiment, although the trimmer 190 is a member having a columnar shape, the trimmer 190 is not limited to this member. For example, as illustrated in FIG. 8, a so-called blade-type trimmer 690 that is formed in a plate-like shape may be employed. The trimmer 690 includes a blade plate 691 that is a plate-shaped elastic member and a blade holding portion 693 that holds the blade plate 691. Here, the blade plate 691 held by the blade holding portion 693 is inclined in such a manner as to extend downward in the top-bottom direction toward the first side in the width direction. In the case illustrated in FIG. 8, a filter 700 and through holes 800 are provided above the blade plate 691 in the top-bottom direction. In addition, a first toner containing chamber 770 is formed on the side opposite to the side on which the developing roller 170 is disposed with the blade holding portion 693 interposed therebetween.

When the blade plate 691 receives the toner falling from the filter 700, the toner is caused to slide along the top surface of the blade plate 691 (see arrow D31). Then, the toner sliding on the top surface of the blade plate 691 falls into the first toner containing chamber 770 (see arrow D32) and is contained in the first toner containing chamber 770.

<Modification 2>

In the above description, although a two-component developer is used, the present disclosure is not limited to using a two-component developer. For example, a mono-component developer may be used. More specifically, although it has been described that the toner contained in the two-component developer floats or moves in the developing device 14, the above-described configuration may also be applied to the case where, for example, a mono-component developer or a carrier that is contained in a two-component developer floats or moves in the developing device 14.

In the above description of FIG. 4, although it has been described that the filter 200 and the through holes 300 are provided only on the far side in the housing 110 in the depth direction, the present disclosure is not limited to this configuration. For example, the filter 200 and the through holes 300 may be provided only on the near side in the housing 110 in the depth direction or may be provided over the entire housing 110 in the depth direction.

In the above description of FIG. 5, although it has been described that an end portion 201 of the filter 200 is located further toward the second side in the width direction than the imaginary line L1 is (see the imaginary line L4), the present disclosure is not limited to this configuration. For example, the end portion 201, which is a portion of the filter 200 located on the second side in the width direction, may be positioned further toward the first side in the width direction than the imaginary line L1 is. As a result, the toner is contained into the first toner containing chamber 270 with higher certainty.

In the above description of FIG. 3, although it has been described that the first toner containing chamber 270 is formed under the filter 200 in the top-bottom direction, the first toner containing chamber 270 may be provided at any position other than the position under the filter 200 in the top-bottom direction as long as the first toner containing chamber 270 is capable of receiving the falling toner.

Note that the photoconductor drum 11 in the above-described description is an example of an image carrier. The developing roller 170 is an example of a toner holding member. The seal 180 is an example of a suppression member. The trimmer 190 is an example of a control member. The filter 200 is an example of a collecting member. The first toner containing chamber 270 is an example of a containing chamber. The second toner containing chamber 290 is an example of another containing chamber. The top surface 197 of the trimmer 190 is an example of a guide surface. Each of the ribs 271 is an example of a restraining wall. The second end chamber 277 is an example of a large width portion. The bottom surface 273 of the first toner containing chamber 270 is an example of a bottom surface. The first auger 130 is an example of a supply member. The developer supplying unit 280 is an example of a changing member. The inclined surface 281 of the developer supplying unit 280 is an example of an inclined surface. The second curved path 253 is an example of a flow path. The second curved surface 251 is an example of a curved surface. The image forming unit 10 is an example of a developing unit.

Although various exemplary embodiments and modifications have been described above, it is obvious that the configurations of these exemplary embodiments and modifications may be combined with one another.

In addition, the present disclosure is in no way limited to the above exemplary embodiments, and various modifications may be made within the gist of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

a toner holding member that rotates while holding a toner on an outer peripheral surface of the toner holding member and develops an electrostatic latent image formed on an image carrier;

a control member that controls a thickness of a layer of the toner formed on the outer peripheral surface of the toner holding member;

a suppression member that has an end pressed against the image carrier and that suppresses leakage of the toner;

a collecting member that is provided above the control member and that does not allow the toner flowing in a direction from the control member toward the collecting member to pass through the collecting member while allowing a gas to pass through the collecting member; and a containing chamber that contains the toner falling from the collecting member and is located below the control member in the top-bottom direction.

2. The developing device according to claim 1, wherein the containing chamber is provided below the collecting member in a vertical direction.

3. The developing device according to claim 2, wherein the control member is provided below the collecting member in the vertical direction and has a guide surface that receives the toner falling from the collecting member and guides the toner to the containing chamber.

4. The developing device according to claim 1, wherein the containing chamber includes a restraining wall that restrains the toner contained in the containing chamber from moving along a rotary shaft of the toner holding member.

5. The developing device according to claim 4, wherein the containing chamber includes a large width portion that is located at an end of the containing chamber in a direction parallel to the rotary shaft of the toner holding member and that has a wide space for containing the toner.

6. The developing device according to claim 5, wherein a bottom surface of the containing chamber is inclined downward in a direction away from the control member.

7. The developing device according to claim 6, further comprising:

another containing chamber that is positioned below the control member and between the containing chamber and the toner holding member and that contains the toner deposited on the control member, wherein the control member is a member having a columnar shape.

8. The developing device according to claim 1, further comprising:

a supply member that is provided along the rotary shaft of the toner holding member and that stirs the toner by rotating and causes the toner to move in the direction parallel to the rotary shaft of the toner holding member in such a manner as to supply the toner to the toner holding member, wherein the collecting member is disposed above the control member and on an upstream side in the direction and is not disposed on a downstream side in the direction.

9. The developing device according to claim 1, further comprising:

a changing member that is disposed downstream from the collecting member in a flow direction of the gas passing through the collecting member and that has a surface inclined with respect to the flow direction such that a direction in which the gas flows is changed by the surface.

10. A developing device comprising:

a toner holding member that rotates while holding a toner on an outer peripheral surface of the toner holding member and develops an electrostatic latent image formed on an image carrier;

a control member that includes a columnar portion provided along a rotary shaft of the toner holding member and that controls a thickness of a layer of the toner formed on the outer peripheral surface of the toner holding member;

a suppression member that has an end pressed against the image carrier and that suppresses leakage of the toner;

a flow path that is separated into paths, while being curved, at a position further downstream than the control member and further upstream than the suppression member in a direction in which the toner holding member rotates and that causes the gas to flow along the control member; and a through hole that allows the gas flowing from the flow path to flow outside.

11. The developing device according to claim 10, wherein the flow path is formed between an outer peripheral surface of the control member and a curved surface that extends along the outer peripheral surface while being spaced apart from the outer peripheral surface.

12. A developing device comprising:

a toner holding member that rotates while holding a toner on an outer peripheral surface of the toner holding member and develops an electrostatic latent image formed on an image carrier;

a control member that controls a thickness of a layer of the toner formed on the outer peripheral surface of the toner holding member;

a suppression member that has an end pressed against the image carrier and that suppresses leakage of the toner;

a collecting member that is provided above the control member and that does not allow the toner flowing in a direction from the control member toward the collecting member to pass through the collecting member while allowing a gas to pass through the collecting member; and a containing chamber that contains the toner falling from above and is located below the control member in the top-bottom direction.

* * * * *